US006255950B1

(12) United States Patent
Nguyen

(10) Patent No.: US 6,255,950 B1
(45) Date of Patent: Jul. 3, 2001

(54) TACK ASSEMBLY FOR ELECTRONIC ARTICLE SURVEILLANCE TAGS

(75) Inventor: Thang Tat Nguyen, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/420,430

(22) Filed: Oct. 19, 1999

(51) Int. Cl.[7] ..... G08B 13/14
(52) U.S. Cl. ..... 340/572.8; 340/572.9
(58) Field of Search ..... 340/572.8, 572.9

(56) References Cited

U.S. PATENT DOCUMENTS

| | | | | |
|---|---|---|---|---|
| Re. 35,361 | | 10/1996 | Hogan et al. . | |
| 3,858,280 | | 1/1975 | Martens . | |
| 3,911,534 | * | 10/1975 | Martens et al. | 24/150 |
| 3,942,829 | | 3/1976 | Humble et al. . | |
| 3,947,930 | | 4/1976 | Martens et al. . | |
| 3,971,269 | | 7/1976 | Martens . | |
| 3,974,581 | | 8/1976 | Martens et al. . | |
| 3,995,900 | | 12/1976 | Humble et al. . | |
| 4,012,813 | | 3/1977 | Martens et al. . | |
| 4,156,302 | * | 5/1979 | Van Niel | 24/155 |
| 4,187,509 | | 2/1980 | Weiner . | |
| 4,221,025 | | 9/1980 | Martens et al. . | |
| 4,229,870 | | 10/1980 | Humble . | |
| 4,523,356 | | 6/1985 | Charlot, Jr. . | |
| 4,531,264 | | 7/1985 | Minasy . | |
| 4,649,397 | | 3/1987 | Heaton et al. . | |
| 4,751,500 | * | 6/1988 | Minasy et al. | 340/572 |
| 4,774,503 | | 9/1988 | Bussard . | |
| 4,774,504 | * | 9/1988 | Hartings | 340/572 |
| 4,944,075 | | 7/1990 | Hogan . | |
| 4,987,754 | | 1/1991 | Minasy et al. . | |
| 5,022,244 | | 6/1991 | Charlot, Jr. . | |
| 5,031,287 | | 7/1991 | Charlot, Jr. et al. . | |
| 5,068,641 | | 11/1991 | Hogen Esch | 340/551 |
| 5,069,047 | | 12/1991 | Lynch et al. . | |
| 5,099,228 | * | 3/1992 | Israel et al. | 340/572 |
| 5,337,459 | | 8/1994 | Hogan . | |
| 5,347,262 | | 9/1994 | Thurmond et al. . | |
| 5,426,419 | | 6/1995 | Nguyen et al. . | |
| 5,428,875 | | 7/1995 | Nguyen et al. . | |
| 5,528,914 | | 6/1996 | Nguyen et al. . | |

FOREIGN PATENT DOCUMENTS

| | | | |
|---|---|---|---|
| 2539035 | 9/1975 | (DE) | A44B/1/34 |

OTHER PUBLICATIONS

Advertisement for "Supertag Electronic Article Surveillance System," Sensormatic Electronics Corporation, Deerfield Beach, FL, 1994.

* cited by examiner

*Primary Examiner*—Jeffery Hofsass
*Assistant Examiner*—Son Tang
(74) *Attorney, Agent, or Firm*—Akerman, Senterfitt & Eidson, P.A.

(57) ABSTRACT

A tack assembly for a security tag includes a housing having an open interior. A tack-head with a tack is movable within the housing between an extended position in which the point of the tack is extended from the housing and a retracted position in which the point of the tack is positioned within the housing. Biasing structure is provided to bias the tack-head and attached tack to the retracted position. A method for safely securing a security tag to and removing a security tag from an article is also provided.

16 Claims, 1 Drawing Sheet

TACK ASSEMBLY FOR ELECTRONIC ARTICLE SURVEILLANCE TAGS

CROSS-REFERENCE TO RELATED APPLICATIONS (Not Applicable)

BACKGROUND OF THE INVENTION

1. Field of the Invention

This invention relates generally to electronic article surveillance systems, and more particularly to tacks used to secure electronic article surveillance tags to articles.

2. Description of the Relevant Art

Tacks are utilized to secure electronic article surveillance (EAS) tags to articles such as garments. The term "tack" traditionally means a one part nail-like metal pin with a large head. It is also used to define a two part assembly of a nail-like metal pin with a large disk shaped plastic head. The tack is pushed through the portion of the garment or article. The tag has a receiving aperture for the tack, and the tag has structure for releasably engaging the tack. The tack/tag assembly cannot be removed from the article without a special tool of some kind, usually a device which magnetically or mechanically moves a portion of the engagement structure of the tag to release the tack. The tag, as is known in the prior art, has structure which is detectable by an electronic monitor. This structure signals the presence of the tag if the article with the tag attached passes the monitor. This signal typically creates an alarm condition, to notify security personnel of the attempted theft of the article. Disengagement structure is usually provided at the check-out location, so that the tack can be disconnected from the tag and the tag can be removed from the article by the cashier at the time that the customer pays for the article.

The removal of the tack from the tag by the cashier or other authorized person creates a hazardous condition because the point of the tack must be relatively sharp in order to pierce the garment or article without damaging it. The exposed point of the tack will pierce skin if handled inappropriately or if an accident occurs. This penetration of the tack creates both a concern for physical injury, as well as infection. Store personnel are trained to properly handle the tacks, however, accidents can still occur. Also, there is a growing interest in self check-out systems in which the customers will themselves pay for goods and remove the tags/tacks without the assistance of cashiers. There would be a risk of injury to the customers by the exposed tacks, and it is therefore desirable to provide a tack/tag assembly which will reduce the risk of injury by the exposed tacks of EAS tags.

SUMMARY OF THE INVENTION

The invention provides a tack assembly for an EAS tag different from the traditional tack. This new-art tack assembly includes a tack (defined herein as a nail-like metal pin), a tack-head (especially shaped), a biasing structure such as a compression spring (spring), and a tack assembly housing (housing). The tack-head is movably mounted within a housing. Biasing structure such as a spring is provided to move the tack-head and tack between an extended position and a retracted position. In the extended position, the tack extends from an aperture in the housing and can be pushed through the article and placed into the receiving aperture of the tag. In the retracted position, the tack is positioned within the housing such that the point of the tack is not exposed and cannot cause injury.

BRIEF DESCRIPTION OF THE DRAWINGS

There are shown in the drawings embodiments of a track assembly according to the invention which are presently preferred, it being understood, however, that the invention is not limited to the precise arrangements and instrumentalities shown, wherein.

DETAILED DESCRIPTION OF THE PREFERRED EMBODIMENTS

Figure 1:
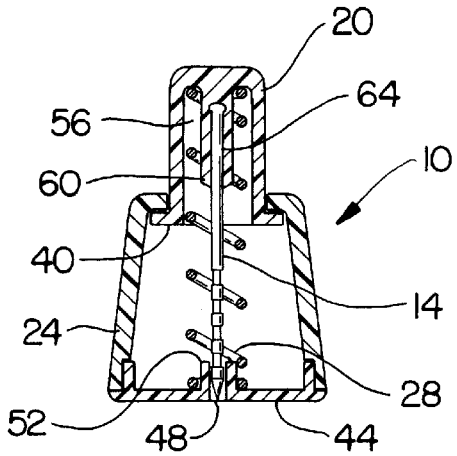
FIG. 1 is a cross section of a tack assembly according to the invention in a first, retracted position.

A tack assembly 1 0 according to the invention as shown in FIG. 1. The tack assembly 10 includes a tack 14 with a point 16 which is attached to a tophat shaped tack-head 20. The tack 14 and tack-head 20 are movably mounted within a housing 24. Biasing structure such as a spring 28 biases the tack 14 and tack-head 20 to the retracted position shown in FIG. 1. The tack-head 20 can be depressed to move the tack-head 20 and tack 14, relative to the housing 24, to the extended position illustrated in FIG. 2. In the extended position, the tack 14 can be pushed through an article and connected to an EAS tag 30, as illustrated in FIG. 3.

Figure 2:
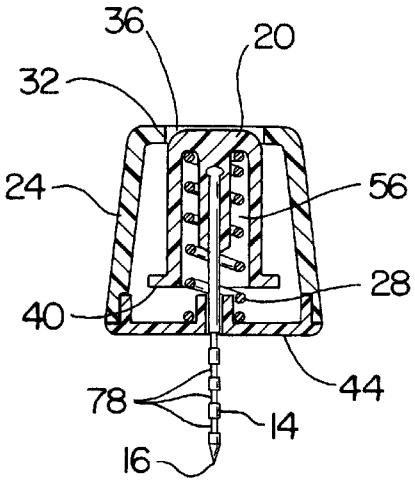
FIG. 2 is a cross section of a tack assembly in a second, extended position.
Figure 3:
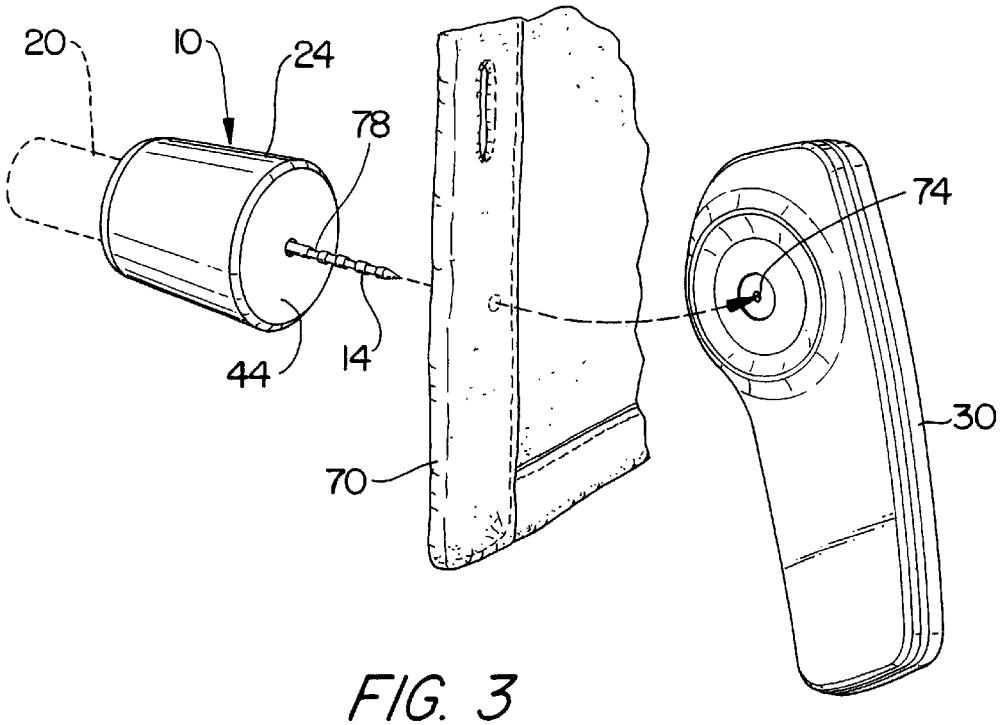
FIG. 3 is an exploded perspective, partially in phantom, illustrating the manner of connection of a tack assembly according to the invention to an article and an EAS tag.

The housing 24 can take many shapes, including the substantially tubular shape shown in FIGS. 1–2. The housing 24 has an end wall 32 with an opening 36 through which the tack-head 20 can move. The outside diameter of the tack-head 20 is preferably slightly less than the diameter of the opening 36 such that the tack-head 20 is freely movable through the opening 36, but without excessive play. Suitable structure such as a flange 40 prevents the tack-head 20 from moving completely out of the housing 24 under the action of the biasing spring 28. A top surface of the flange 40 will contact an inside surface of the end wall 32 to retain the tack-head 20 within the housing 24.

The housing 24 has a base 44. The base 44 closes the housing 24 but has an opening 48 through which the tack 14 can travel. Opening 48 extends through tubular boss 52 to maintain concentric location of tack 14 while in the retracted position. The outside wall of tubular boss 52 can locate the base end of spring 28 concentrically about tack 14, and adjacent interior wall of base 44 can provide a seat for the base end of spring 28. The base 44 can be secured to the housing by any suitable method, including glueing and welding.

The tack 14 can be secured to the tack-head 20 by any suitable method. Preferably, the tack-head 20 has an open interior 56 to permit the spring 28 to be substantially positioned in this space when the tack-head 20 is depressed into the housing 24, as shown in FIG. 2. A spring guide 60, preferably in the form of a post, can be provided in the space 56. The tack-head end of spring 28 thus can be located concentrically about the tack 14. The inside surface of the top of tack-head 20 can provide a seat for the tack-head end of spring 28. Even when tack-head 20 is in the retracted position, spring 28 continues to apply bias. Also, one end of the tack 14 can be secured within the spring guide 60, and the spring guide 60 thereby also serves the function as the point of connection of the tack 14 to the tack-head 20.

In operation, the tack assembly 10 is secured to an article such as a garment 70 by pushing the tack 14 through the garment 70 in the manner depicted in FIG. 3. In the tack assembly 10, however, the tack 14 is normally in the retracted position shown by the phantom lines in FIG. 3, in which the point 16 of the tack 14 is retracted into the housing and the tack-head 20 extends from the housing 24. The tack-head 20 must be depressed into the housing 24 to extend the tack 14 from the housing 24. The tack-head 20 must be held in the depressed position while the tack 14 is pushed through the article 70. The tack 14 is then positioned in the receiving aperture 74 of the EAS tag 30, and is thereby engaged to the tag 30. The tag 30 can engage the tack 14 by any suitable means. The tack 14 can have a series of grooves 78, as is known in the prior art, and the tag 30 has structure such as a leaf spring for engaging one of the grooves 78 as the tack 14 is pushed into the receiving aperture 74. The tack assembly 10 thereby securely engages the security tag 30 to the article 70 until an appropriate disengagement tool is applied to remove the tag 30 from the tack assembly 10. The tool is kept at the cashier's station or at any other appropriate location. The tool mechanically, electrically or magnetically releases the tack 14 from the tag 30. The tool can also be provided at customer self check out locations. Upon release of the tack 14 from the tag 30, the biasing spring 28 will act to extend the tack-head 20 through the opening 36 to the retracted position shown in FIG. 1. The point 16 of the tack 14 will thereby be retracted into the housing 24, where it cannot cause physical injury.

The tack assembly of the invention can be made of any suitable material. The housing 24 and tack-head 20 can be made from durable plastic materials. The tack 14 is preferably made of a noncorroding metal, but can also be made from other materials including plastic.

It is preferable to prevent accidental movement of the tack 14 to the extended position. Such unintended movement could result in physical injury. Accordingly, an interlock can be provided which locks the tack 14 at the retracted position. The interlock must be released in order to move the tack 14 to the extended position.

Although the invention has particularly a utility for electronic article surveillance tags, it will be appreciated that the invention is also useful for other types of security tags. The invention is capable of taking alternative forms without departing in the spirit or essential attributes thereof, and accordingly reference should be made to the following claims, rather than the foregoing specification, as indicating the scope of the invention.

I claim:

1. A tack assembly for a security tag, comprising:

a housing having an open interior;

a tack-head with a tack, the tack having a point, said tack assembly being disengageable and separable from said security tag;

biasing structure, said biasing structure biasing said tack-head and the attached tack between a first, extended position in which the point of the tack is extended from the housing, and a second, retracted position in which the point of the tack is positioned within the housing.

2. The tack assembly of claim 1, wherein said housing comprises an end wall with an opening, said button being movable through said opening, said tack-head having structure for preventing the tack-head from moving completely out of the opening under the action of said biasing structure.

3. The tack assembly of claim 2, wherein said tack-head comprises a flange, said flange contacting said end wall to prevent the movement of said tack-head out of said housing under the action of said biasing structure.

4. The tack assembly of claim 1, wherein said biasing structure is a compression spring.

5. The tack assembly of claim 4, wherein said tack-head has an open interior, and a spring seat positioned inside said open interior.

6. The tack assembly of claim 5, wherein said spring seat has a concentric interior spring locating post and one end of said tack is secured within said post.

7. The tack assembly of claim 1, wherein said housing comprises an end wall, said end wall comprising a spring seat, said spring seat having an opening dimensioned to receive said tack.

8. The security tag/tack assembly of claim 1, wherein said tag is an electronic article surveillance tag.

9. A security tag/tack assembly, comprising:

a security tag having a receiving aperture for a tack, and engagement structure for releasably engaging said tack;

a tack assembly comprising a housing having an open interior, a tack-head with a tack having a point, said tack assembly being disengageable and separable from said security tag, said tack-head and tack being movable in said open interior of said housing between an extended position in which the point of the tack is extended from said housing, and a retracted position in which the point of the tack is retracted within said housing; and biasing structure for moving said tack-head from said extended position to said retracted position.

10. The tag/tack assembly of claim 9, wherein said housing comprises an end wall with an opening, said tack-head being movable through said opening, said tack-head having structure for preventing the tack-head from moving completely out of the opening under the action of said biasing structure.

11. The tag/tack assembly of claim 10, wherein said tack-head comprises a flange, said flange contacting said end wall to prevent the movement of said tack-head out of said housing under the action of said biasing structure.

12. The tag/tack assembly of claim 11, wherein said biasing structure is a compression spring.

13. The tag/tack assembly of claim 12, wherein said housing comprises an end wall, said end wall comprising a spring seat, said spring seat having an opening dimensioned to receive said tack.

14. The tag/tack assembly of claim 13, wherein said tack-head has an open interior, and a spring seat positioned inside said open interior.

15. The tag/tack assembly of claim 14, wherein said spring seat has a concentric interior spring locating post, and one end of said tack is secured within said post.

16. A method for safely securing articles against theft, comprising the steps of:

providing a security tag/tack assembly comprising a security tag and a tack assembly having a housing with an open interior, a tack-head with a tack, the tack having a point, said tack assembly being disengageable and separable from said security tag, said tack-head and attached tack being movable within said interior between an extended position in which the point of the tack is extended from the housing and a retracted position in which the point of the tack is positioned within the housing;

depressing the tack-head to extend the point of the tack from the housing;

pushing the tack through an article that is to be secured;

engaging the tack to the security tag by positioning the tack in a receiving aperture of the security tag; and, removing the security tag from the tack, whereupon the point of the tack will be withdrawn into the housing by operation of the biasing structure.

* * * * *

UNITED STATES PATENT AND TRADEMARK OFFICE

CERTIFICATE OF CORRECTION

PATENT NO. : 6,255,950 B1
DATED : July 3, 2001
INVENTOR(S) : Nguyen et al.

It is certified that error appears in the above-identified patent and that said Letters Patent is hereby corrected as shown below:

Title page,
Item [75], list of inventors, insert -- Dennis Hogan, Lighthouse Point, FL (US) --.

Column 2,
Line 10, replace “track” with -- tack --.
Line 15, replace “cross section” with -- cross-section --.
Line 17, replace “cross section” with -- cross-section --.

Column 3,
Line 35, replace “self check” with -- self-check --.

Column 4,
Line 13, replace “button” with -- tack-head --.

Signed and Sealed this

Tenth Day of September, 2002

*Attest:*

*Attesting Officer*

JAMES E. ROGAN
*Director of the United States Patent and Trademark Office*